US006175263B1

(12) United States Patent
Lee et al.

(10) Patent No.: US 6,175,263 B1
(45) Date of Patent: Jan. 16, 2001

(54) BACK BIAS GENERATOR HAVING TRANSFER TRANSISTOR WITH WELL BIAS

(75) Inventors: Kyu-chan Lee; Hong-il Yoon, both of Seoul (KR)

(73) Assignee: Samsung Electronics, Co., Ltd., Suwon (KR)

( * ) Notice: Under 35 U.S.C. 154(b), the term of this patent shall be extended for 0 days.

(21) Appl. No.: 09/104,857

(22) Filed: Jun. 24, 1998

(30) Foreign Application Priority Data

Jun. 26, 1997 (KR) ..... 97-27609

(51) Int. Cl.[7] ..... G05F 1/10; G05F 3/02
(52) U.S. Cl. ..... 327/536; 327/534
(58) Field of Search ..... 327/534, 535, 327/536, 537, 143

(56) References Cited

U.S. PATENT DOCUMENTS 5,247,208 * 9/1993 Nakayama ..... 327/534
5,408,140 * 4/1995 Kawai et al. ..... 327/536
5,546,044 * 8/1996 Calligagaro et al. ..... 327/543
5,909,141 * 6/1999 Tomishima ..... 327/536

FOREIGN PATENT DOCUMENTS

0062894 * 10/1982 (EP) ..... 327/534

* cited by examiner

*Primary Examiner*—Terry D. Cunningham
*Assistant Examiner*—Anh-Quan Tra
(74) *Attorney, Agent, or Firm*—Marger Johnson & McCollom, P.C.

(57) ABSTRACT

A back bias generator for a semiconductor device improves refresh characteristics, reduces leakage current, and increases back bias supply capacity in a DRAM having a triple well structure by applying a well bias voltage to the bulk of an NMOS transfer transistor. The back bias generator includes a well bias generator that generates the well bias voltage before the pumping voltage is applied to the transfer transistor. The well bias provides a back bias to a parasitic NPN transistor formed in the triple well of the NMOS transfer transistor, thereby preventing leakage through the NPN into the substrate. The well bias is also applied to the bulk of a clamp transistor that initializes a pumping capacitor.

20 Claims, 6 Drawing Sheets

BACK BIAS GENERATOR HAVING TRANSFER TRANSISTOR WITH WELL BIAS

This application corresponds to Korean patent application No. 97-27609 filed Jun. 26, 1997 in the name of Samsung Electronics Co., Ltd., which is herein incorporated by reference for all purposes.

BACKGROUND OF THE INVENTION

1. Field of the Invention

This invention relates generally to semiconductor devices, and more particularly, to a method and apparatus for reducing leakage current in a transfer transistor in a back bias voltage generator for a DRAM semiconductor device.

2. Description of the Related Art

A DRAM semiconductor device has a plurality of memory cells for storing information and peripheral circuits for reading and writing data to the memory cells. During operation of a DRAM semiconductor device, leakage current can be generated between the memory cells, the peripheral circuits, and the substrate of the DRAM device. To prevent leakage current, a back bias generator is used to apply a back bias to the substrate.

FIG. 1 is a circuit diagram of a conventional back bias generator for a DRAM semiconductor device. Referring to FIG. 1, the conventional back bias generator 5 includes an oscillator 11, a power-supply voltage generator 13, a NAND gate 15, a pumping capacitor (Cp), a clamp transistor 17 and a PMOS transfer transistor 19.

The operation of the back bias generator for a semiconductor device 5 will now be explained. When the power-supply voltage generator 13 begins generating a power-supply voltage Vcc, the oscillator 11 generates a clock signal. In response to the clock signal, the pumping capacitor Cp generates a negative pumping voltage. The negative pumping voltage is generated as a back bias $V_{BB}$ through the transfer transistor 19.

FIG. 2 is a sectional view of a DRAM semiconductor device 7 showing the structure of transfer transistor 19. Referring to FIG. 2, an N well 23 is formed in a P-substrate 21. A source 25 and a drain 27 for the transfer transistor 19 are formed in the N well 23.

As DRAM memory cells become more highly integrated, the design rule is reduced and the level of a power-supply voltage Vcc is lowered. Accordingly, the power-supply capacity of a back bias generator becomes insufficient. Therefore, to improve the power supply capacity of the back bias generator for a semiconductor device, the PMOS transistor used as the transfer transistor shown in FIG. 1 must be replaced with an NMOS transistor. This is because an NMOS transistor has a threshold voltage that is lower than that of a PMOS transistor while having a greater driving capacity.

FIG. 3 is a circuit diagram of a conventional back bias generator 35 that utilizes an NMOS transistor as a transfer transistor 39. The power supply capacity of the back bias generator 35 of FIG. 3 is greater than that of the circuit of FIG. 1. However, when the circuit shown in FIG. 3 is utilized in a DRAM semiconductor device having a triple-well structure, as shown in FIG. 4, a leakage current il is generated between the transfer transistor 39 and the P-substrate 21 because a PNP structure 43 is formed between the transfer transistor 39 and the P-substrate 21. Reference numeral 30 designates the gate of transfer transistor 39.

Referring to FIGS. 3 and 4, the negative pumping voltage generated by the pumping capacitor Cp does not pass through the transfer transistor 39 but is discharged to the P-substrate 21 through the PNP structure 43. This reduces the power supply capacity of the back bias generator 35 shown in FIG. 3. Accordingly, leakage current is generated between memory cells (not shown) that utilize the back bias $V_{BB}$. This phenomenon is serious at power-up time. The leakage current deteriorates the refresh characteristics of the DRAM semiconductor device. Also, instability of the back bias level due to noise in the DRAM reduces the response time of the device.

Accordingly, a need remains for an improved scheme for generating a back bias signal in a semiconductor device.

SUMMARY OF THE INVENTION

Therefore, it is an object of the present invention to improve the refresh characteristics of a DRAM semiconductor device.

Another object of the present invention is to reduce leakage current in a DRAM semiconductor device.

A further object of the present invention is to improve the back bias supply capacity of a back bias generator for a semiconductor device.

To accomplish these and other objects, a back bias generator for a semiconductor device constructed in accordance with the present invention applies a well bias voltage to the bulk of an NMOS transfer transistor formed in a triple well structure. The back bias generator includes a well bias generator that generates the well bias voltage before the pumping voltage is applied to the transfer transistor. The well bias provides a back bias to a parasitic NPN transistor formed in the triple well of the NMOS transfer transistor, thereby preventing leakage through the NPN into the substrate. The well bias is also applied to the bulk of a clamp transistor that initializes a pumping capacitor.

One aspect of the present invention is a back bias generator for a semiconductor device having a triple well structure, comprising: an oscillator for generating a clock signal; a well bias generator coupled to the oscillator for generating a well bias signal in response to the clock signal; a power-supply voltage generator for generating a power-supply voltage; a logic gate coupled to the power-supply voltage generator and the oscillator for generating a logic signal responsive to the power supply voltage and the clock signal; a pumping capacitor coupled between the logic gate and a node for generating a pumping voltage at the node in response to the logic signal; and a transfer transistor having a first electrode coupled to the node, a bulk coupled to the well bias generator to receive the well bias signal, and a gate and second electrode coupled together, for generating a back bias signal at the second electrode. In a preferred embodiment, the voltage of the well bias signal is lower then the voltage of the back bias signal after the power-supply voltage reaches a predetermined level.

Another aspect of the present invention is a back bias generator for a semiconductor device having a triple well structure comprising: logic means for generating a logic signal that is at a first logic state if a power supply signal is below a predetermined level, a second logic state if a clock signal is at a third logic state, and the first logic state if the power supply signal is above the predetermined level and the clock signal is at a fourth logic state; a pumping capacitor coupled to the logic means, the pumping capacitor generating a pumping signal responsive to the logic signal; a transfer transistor coupled to the capacitor for receiving the pumping signal and generating a back bias signal; and bias means for generating a well bias signal coupled to the transfer transistor for providing a well bias signal to a bulk of the transfer transistor, thereby preventing leakage through the triple well structure. In a preferred embodiment the back bias generator further includes a clamp transistor coupled to the pumping capacitor for initializing the voltage of the pumping capacitor, the clamp transistor having a bulk coupled to the bias means for receiving the well bias signal. The bias means provides the well bias signal before the logic means causes the pumping capacitor to generate the pumping signal.

A further aspect of the present invention is a method for operating a back bias generator having a transfer transistor fabricated in a triple well structure, wherein a first well of the triple well structure forms the bulk of the transfer transistor, the method comprising: generating a pumping signal; applying the pumping signal to a first terminal of the transfer transistor; generating a well bias signal; and applying the well bias signal to the bulk of the transfer transistor, thereby preventing leakage through the triple well structure.

An advantage of the present invention is that it reduces leakage in a transfer transistor in a back bias generator.

Another advantage of the present invention is that it improves back bias supply capacity of a back bias generator.

The foregoing and other objects, features and advantages of the invention will become more readily apparent from the following detailed description of a preferred embodiment of the invention which proceeds with reference to the accompanying drawings.

DETAILED DESCRIPTION

Figure 1:
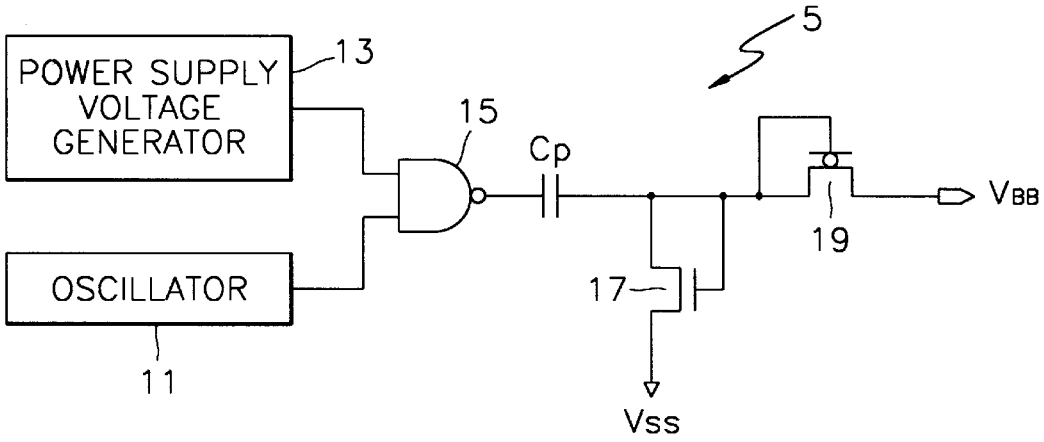
FIG. 1 (PRIOR ART)
FIG. 1 is a circuit diagram of a prior art back bias generator for a DRAM semiconductor device.
Figure 2:
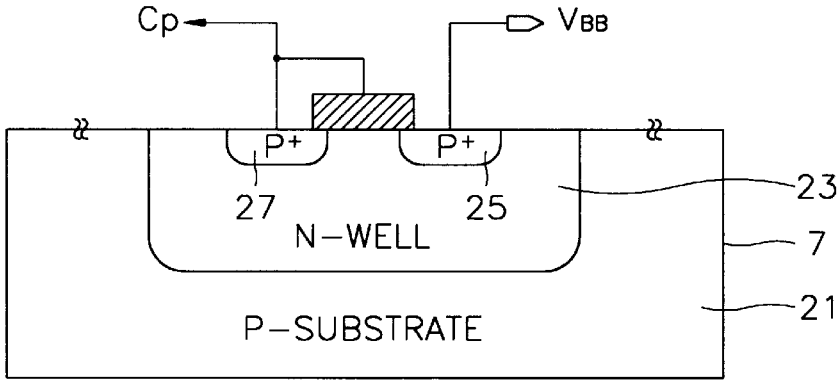
FIG. 2 (PRIOR ART)
FIG. 2 is a sectional view of the transfer transistor shown in FIG. 1.
Figure 3:
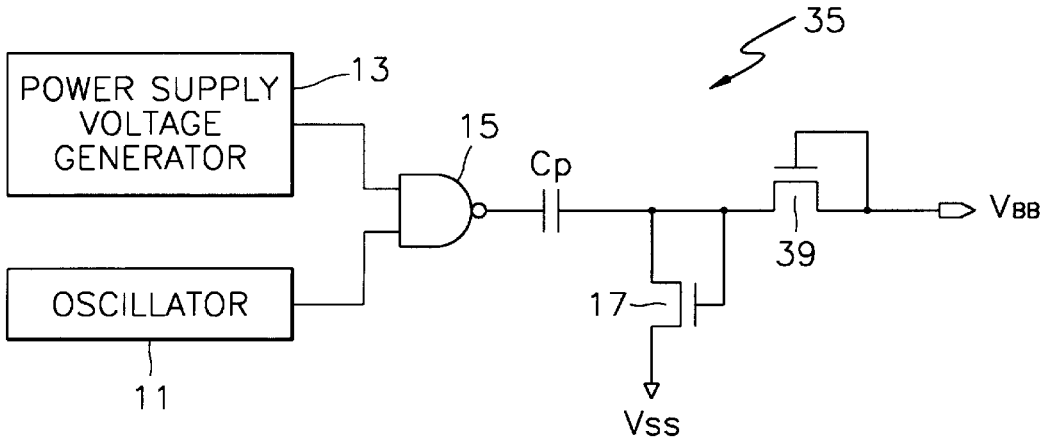
FIG. 3 (PRIOR ART)
FIG. 3 is a circuit diagram of a prior art back bias generator for a semiconductor device using an NMOS transistor as the transfer transistor shown in FIG. 1.
Figure 4:
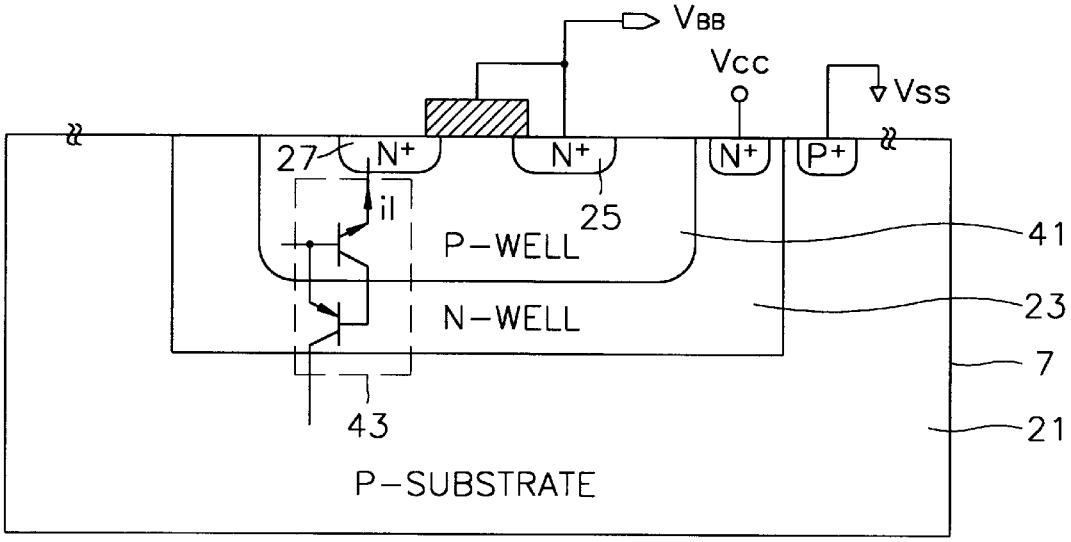
FIG. 4 (PRIOR ART)
FIG. 4 is a sectional view illustrating the transfer transistor of FIG. 3 where the transfer transistor shown in FIG. 3 is formed in a semiconductor device having a triple-well structure.
Figure 5:
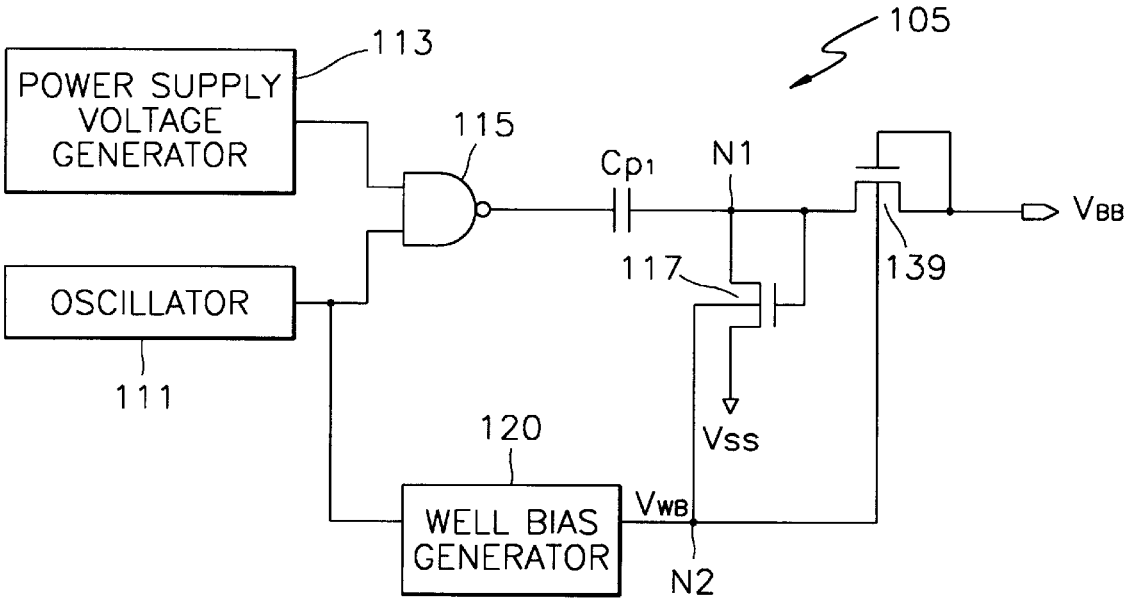
FIG. 5 is a schematic diagram of an embodiment of a back bias generator for a semiconductor device in accordance with the present invention.

FIG. 5 is a schematic diagram of an embodiment of a back bias generator for a semiconductor device in accordance with the present invention. Referring to FIG. 5, the back bias generator for a semiconductor device 105 includes an oscillator 111, a power-supply voltage generator 113, a logic gate 115, e.g. a NAND gate, a pumping capacitor Cp1, a clamp transistor 117, a transfer transistor 139 and a well bias generator 120.

Figure 7:
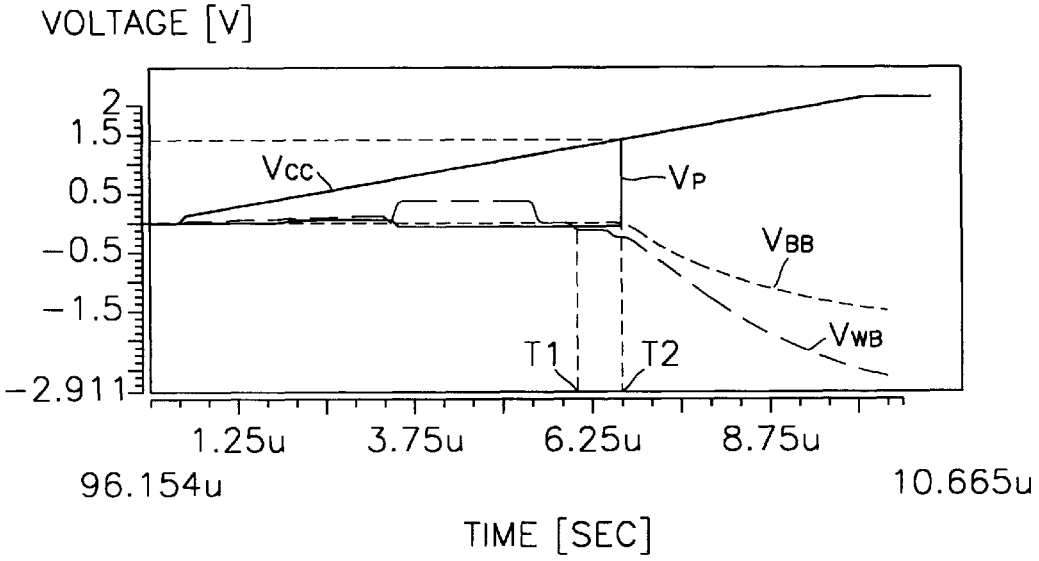
FIG. 7 is a waveform diagram showing the results of a simulation of the back bias generator shown in FIG. 5.

The oscillator 111 generates a clock signal. The power-supply voltage generator 113 generates a voltage Vp that goes 'high' when a power-supply voltage Vcc reaches a predetermined level, as shown in FIG. 7. The logic gate 115 performs a negative logic product operation on the output of the oscillator 111 and the output of the power-supply voltage generator 113. In other words, when either the output of the oscillator 111 or the output of the power-supply voltage generator 113 is logic low, the output of the logic gate 115 goes high. When the output of the oscillator 111 and the output of the power-supply voltage generator 113 are both logic low, the output of the logic gate 115 goes low.

The pumping capacitor Cp1 accumulates charge and outputs a negative pumping voltage when the level of the voltage output from the logic gate 115 is logic low. The output port of the logic gate 115 is connected to one end of the pumping capacitor Cp1, while the source of the transfer transistor 139 and the drain of the clamp transistor 117 are connected to the other end of the pumping capacitor Cp1.

The clamp transistor 117 is formed from an NMOS transistor. Before the back bias generator 105 operates, the voltage level of clamp transistor 117 is initialized to a voltage level that is equal to the threshold voltage of the clamp transistor 117.

The transfer transistor 139 is also formed from an NMOS transistor. The transfer transistor 139 outputs the negative pumping voltage from the pumping capacitor Cp1 as the back bias voltage $V_{BB}$.

The input port of the well bias generator 120 is connected to the output port of the oscillator 11, and the output port thereof is commonly connected to the bulk of the transfer transistor 139 and the bulk of the clamp transistor 117. The well bias generator 120 receives a clock signal from the oscillator 111 and supplies a well bias signal having a negative voltage level to the bulk of the transfer transistor 139 and the bulk of the clamp transistor 117.

Figure 6:
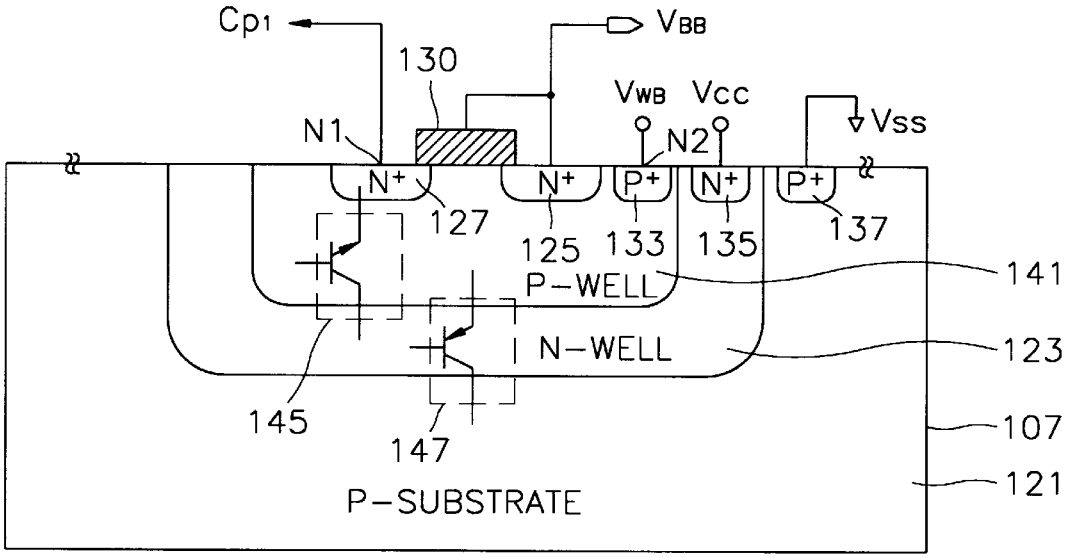
FIG. 6 is a sectional view of the transfer transistor shown in FIG. 5.

FIG. 6 is a sectional view of the transfer transistor shown in FIG. 5. Referring to FIG. 6, an N well 123 is formed on a P-type substrate 121, a P well 141 is formed within the N well 123, and heavily concentrated N-type impurities 125 and 127 are doped into the P well 141 to form the source and drain of the transfer transistor shown in FIG. 5. A gate electrode 130 is formed between the source and drain of the transfer transistor 139.

The pumping capacitor Cp1 shown in FIG. 5 is connected to the drain of the transfer transistor 139, i.e., a node N1. Also, heavily concentrated P-type impurities are doped into a region 133 of the P well 141, and the output port of the well bias generator 105, i.e., node N2, is connected to the heavily concentrated P-type impurity region 133. Heavily concentrated N-type impurities 135 are doped into the N well 123 and are then connected to the power-supply voltage Vcc. Heavily concentrated N-type impurities 135 are doped into the P-type substrate 121 and then connected to the ground voltage Vss.

If a negative voltage is applied to the node N1 in the semiconductor device 107 shown in FIG. 6, an NPN transistor 145 is formed by the heavily doped N-type impurities 127 connected to the node N1, the P well 141 and the N well 123. A PNP transistor 147 is formed by the P well 141, the N well 123 and the P-type substrate 121. In other words, if a negative voltage is applied to the node N1, the negative pumping voltage generated from the pumping capacitor Cp1 does not pass through the transfer transistor 139, but instead, heads toward the P-type substrate 121 through the NPN transistor 145 and the PNP transistor 147. Thus, the back bias generator 105 cannot achieve its function of generating a back bias $V_{BB}$.

To prevent this problem, a well bias $V_{WB}$ is applied to the heavily concentrated P-type impurities 133. Then, even if a negative voltage is applied to the node N1, the negative pumping voltage from the pumping capacitor Cp1 is generated as a back bias $V_{BB}$ through the transfer transistor 139 because a back bias is applied to the NPN transistor 145.

Referring to FIG. 6, the operation of the back bias generator for a semiconductor device 107 shown in FIG. 5 will be described in more detail. When the power-supply voltage Vcc is turned on at an initial stage, the oscillator 111 begins operating immediately to generate a clock signal. The output of the power-supply voltage generator 113 is logic low until the power-supply voltage Vcc reaches a predetermined level. Thus, the logic gate 115 outputs a logic signal at a logic high level. When the output of the logic gate 115 is logic 'high,' the pumping capacitor Cp1 charges. When the oscillator 111 operates, the well bias generator 120 receives the clock signal from the oscillator 111 and supplies a negative well bias voltage $V_{WB}$ to the bulk of the clamp transistor 117 and the bulk of the transfer transistor 139.

When the power-supply voltage Vcc reaches the predetermined level, the power-supply voltage generator 113 outputs the voltage signal Vp at a logic high level, and the output of the logic gate 115 is then determined by the state of the clock signal from the oscillator 111. In other words, if the clock signal is logic 'high,' the output of the logic gate 115 goes 'low.' If the clock signal goes 'low,' the output of the logic gate 115 goes 'high.' If the output of the logic gate 115 goes 'low,' the level of node N1 falls from the initial ground voltage Vss to a negative voltage. In other words, the pumping capacitor Cp1 generates a negative pumping voltage which is generated as the back bias $V_{BB}$ through the transfer transistor 139.

When the negative pumping voltage is generated, the negative well bias voltage $V_{WB}$ is applied to the P well 141 of the semiconductor device 107. Thus, a back bias is applied to the NPN transistor 145. The negative pumping voltage does not leak through the P-type substrate 121 through the NPN transistor 145 and the PNP transistor 147, but instead, passes through the transfer transistor 139 to provide the back bias $V_{BB}$.

FIG. 7 is a diagram showing the results of a simulation of the back bias generator shown in FIG. 5. As shown in FIG. 7, when the power-supply voltage Vcc reaches a predetermined level, e.g., 1.4 V, the voltage Vp is generated from the power-supply voltage generator 113 shown in FIG. 5, and the back bias $V_{BB}$ is gradually generated without leakage. The well bias $V_{WB}$ is generated from time T1 which is before the back bias $V_{BB}$ is generated, that is, before the voltage Vp is generated.

Figure 8:
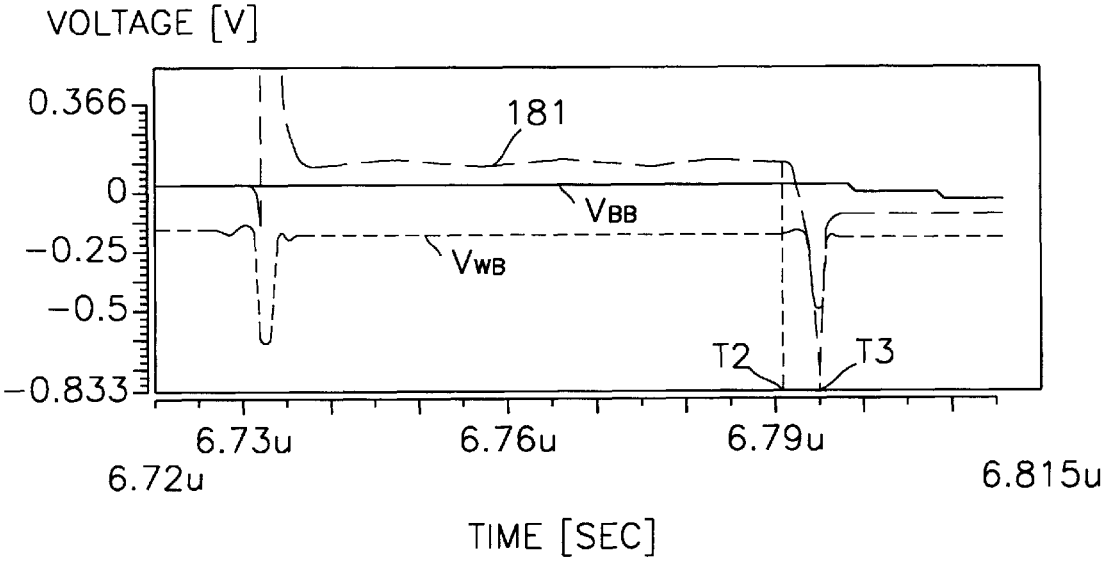
FIG. 8 is a waveform diagram showing an expanded view of the back bias $V_{BB}$ and well bias $V_{WB}$ of FIG. 7 near the time T2 when the voltage Vp is generated.

FIG. 8 is a waveform diagram showing an expanded view of the back bias $V_{BB}$ and well bias $V_{WB}$ of FIG. 7 near the time T2 when the voltage Vp is generated, as well as the voltage 181 of the node N1 shown in FIG. 5. Referring to FIG. 8, the voltage 181 of the node N1 is higher than the ground voltage Vss by a voltage equal to the threshold voltage of the clamp transistor 117 until the voltage Vp is goes high. The voltage level of the back bias $V_{BB}$ is the same as that of the ground voltage Vss. The well bias $V_{WB}$ is a negative voltage, e.g., −0.2 V, which is slightly lower than the ground voltage Vss. At time T2, when the voltage Vp is generated, the voltage 181 of the node N1 is lowered to a negative level, and thus the back bias $V_{BB}$ is lowered to a negative level. The voltage 181 of the node N1 and the voltage level of the well bias $V_{WB}$ sharply decrease instantaneously at time T3 when the clock signal of the oscillator 111 shown in FIG. 5 is logic low.

Figure 9:
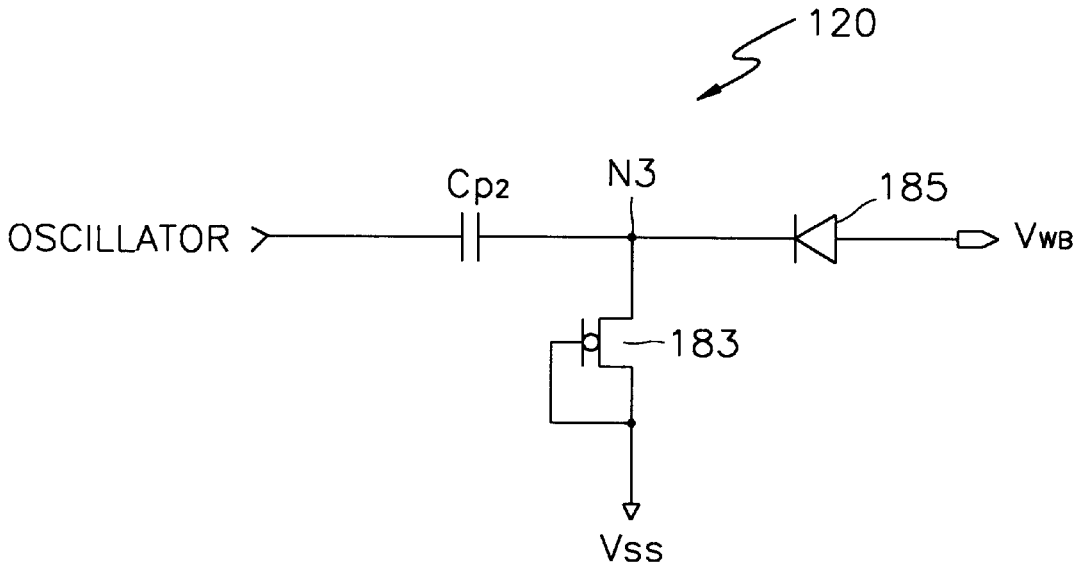
FIG. 9 is a circuit diagram of an embodiment of the well bias generator shown in FIG. 5 according to the present invention.

FIG. 9 is a circuit diagram of an embodiment of the well bias generator shown in FIG. 5 according to the present invention. Referring to FIG. 9, the well bias generator 120 includes a diode 185, a PMOS transistor 183 and a first capacitor Cp2. One terminal of the first capacitor Cp2 is connected to the oscillator 111 shown in FIG. 5 and the other terminal thereof is connected to the cathode of the diode 185 and a first electrode of the PMOS transistor 183, e.g., a source. The ground voltage Vss is commonly applied to a second electrode of the PMOS transistor 183, i.e., a drain and a gate. The well bias $V_{WB}$ is generated at the anode of the diode 185.

The operation of the well bias generator 120 will be described with reference to FIG. 9. During an initial stage, the voltage level of a first electrode of the PMOS transistor 183, i.e., a node N3, is higher than the ground voltage Vss by a voltage equal to the threshold voltage of the PMOS transistor 183. In this state, when the clock signal is logic high, the first capacitor Cp2 accumulates charge. When the clock signal goes low, the voltage level at node N3 decreases to a negative level. Therefore, the well bias $V_{WB}$ becomes a negative voltage that is higher than the voltage level of the node N3 by the built-in voltage of the diode 185. An advantage of the embodiment of the well bias generator shown in FIG. 9 is that the well bias $V_{WB}$ is generated faster than the back bias $V_{BB}$.

Figure 10:
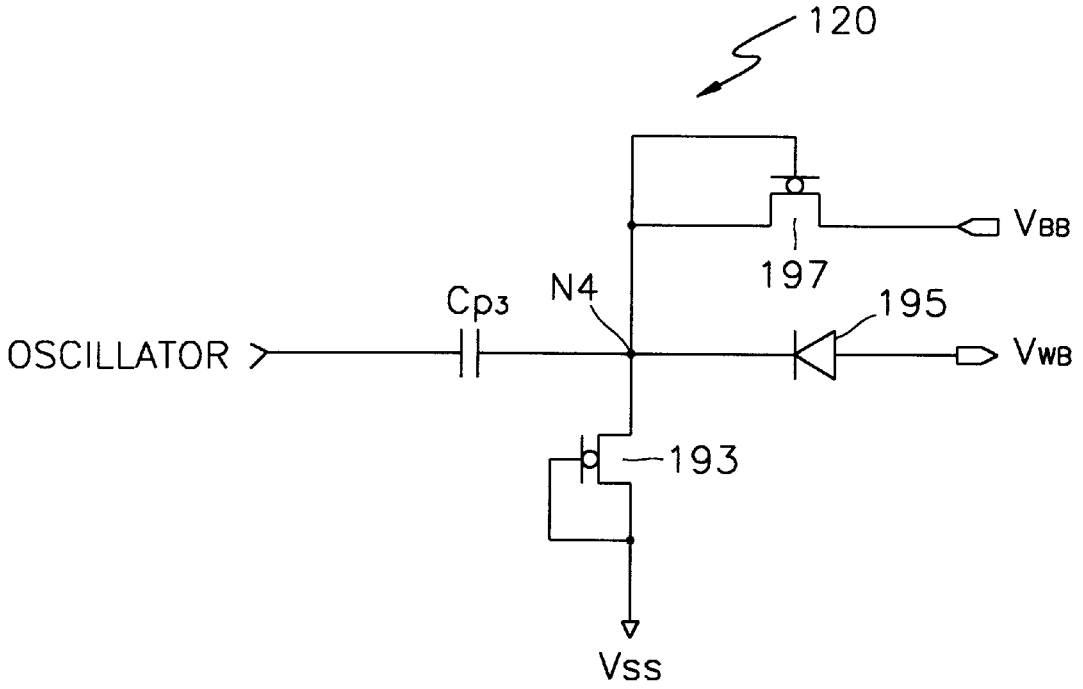
FIG. 10 is a circuit diagram of another embodiment of the well bias generator shown in FIG. 5 according to the present invention.

FIG. 10 is a circuit diagram of a second embodiment of the well bias generator shown in FIG. 5 according to the present invention. Referring to FIG. 10, the well bias generator 120 includes a diode 195, two PMOS transistors 193 and 197 and a second capacitor Cp3. One terminal of the second capacitor Cp3 is connected to the oscillator 111 shown in FIG. 5, and the other terminal thereof is connected to the cathode of diode 195, a first electrode of the PMOS transistor 193, i.e., a source, and a second electrode of the PMOS transistor 197, e.g., a drain. The ground voltage Vss is applied to the second electrode of the PMOS transistor 193, e.g., the drain, and the back bias $V_{BB}$ is applied to the first electrode of the PMOS transistor 197, e.g., the source. The second electrode of the PMOS transistor 197 and the gate are connected together. The well bias $V_{WB}$ is generated at the anode of diode 195.

The operation of the well bias generator 120 will now be described with reference to FIG. 10. In an initial state, the voltage Vn4 at node N4 is can be expressed as:

$$Vss<Vn4<(Vtp+Vss) \quad (1)$$

where Vtp is the absolute value of the threshold voltage of PMOS transistor 193. The voltage Vn4 of the node N4 is lower than (Vtp+Vss) because the voltage Vn4 of the node N4 is reduced by the PMOS transistor 197. In this state, when the clock signal is generated by the oscillator (111 of FIG. 5), when the clock signal is logic 'high,' charge accumulates in the second capacitor Cp3. When the clock signal goes 'low,' the voltage Vn4 of the node N4 decreases to a negative level. Therefore, the well bias $V_{WB}$ becomes a negative voltage that is higher than the voltage level of the node N4 by an amount equal to the built-in voltage of the diode 195. An advantage of the circuit shown in FIG. 10 is that the well bias $V_{WB}$ is generated easily.

Figure 11:
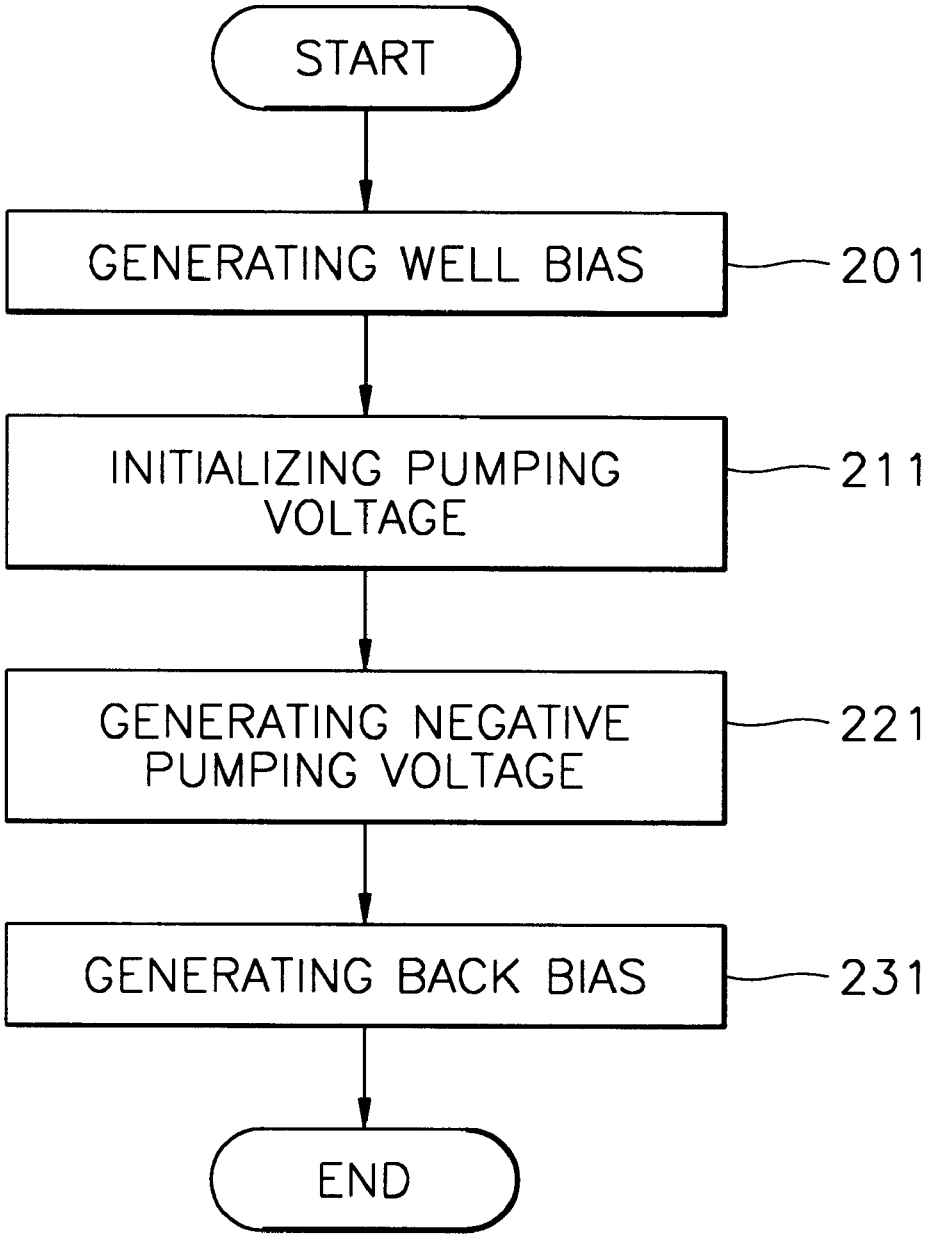
FIG. 11 is a flow diagram illustrating an embodiment of a method for generating a back bias for a semiconductor device in accordance with the present invention.

FIG. 11 is a flow diagram illustrating an embodiment of a method for generating a back bias for a semiconductor device in accordance with the present invention. Referring to FIG. 11, a method for operating a back bias generator having an oscillator, a pumping capacitor, a well bias generator and an NMOS transistor for a transfer transistor fabricated in a triple-well structure comprise generating a well bias (step 201), initializing a pumping voltage (step 211), generating a negative pumping voltage (step 221) and generating a back bias (step 231).

In step 201, the well bias generator generates a negative well bias voltage as soon as the power voltage is applied to the well bias generator. The well bias voltage is then applied to the bulk of the transfer transistor. In step 211, the pumping capacitor is initialized to a voltage close to the ground voltage. In step 221, the pumping capacitor generates the negative pumping voltage in response to the output signal of the oscillator when the power-supply voltage reaches a predetermined level. In step 231, the transfer transistor generates the back bias.

As described above, a back bias generator constructed and operated in accordance with the present invention provides improved back bias supply capacity.

Having described and illustrated the principles of the invention in a preferred embodiment thereof, it should be apparent that the invention can be modified in arrangement and detail without departing from such principles. We claim all modifications and variations coming within the spirit and scope of the following claims.

What is claimed is:

1. A back bias generator for a semiconductor device having a triple well structure, comprising:

an oscillator for generating a clock signal;

a well bias generator coupled to the oscillator for generating a well bias signal in response to the clock signal;

a power-supply voltage generator for generating a power-supply voltage;

a logic gate coupled to the power-supply voltage generator and the oscillator for generating an oscillating logic signal responsive to the power supply voltage and the clock signal;

a pumping circuit coupled between the logic gate and a node for generating a pumping voltage at the node in response to the oscillating logic signal; and a transfer transistor having a first electrode coupled to the node, a bulk coupled to the well bias generator to receive the well bias signal, and a gate and second electrode coupled together, for generating a back bias signal at the second electrode.

2. The back bias generator for a semiconductor device according to claim 1, wherein the well bias signal, the pumping voltage, and the back bias signal have a negative voltage.

3. The back bias generator for a semiconductor device according to claim 1, wherein the voltage of the well bias signal is lower then the voltage of the back bias signal after the power-supply voltage reaches a predetermined level.

4. The back bias generator for a semiconductor device according to claim 1, wherein the pumping circuit comprises:

a pumping capacitor coupled between the logic gate and the node; and a clamp transistor having a first electrode and gate commonly coupled to the node, a second electrode coupled to a ground voltage, and a bulk coupled to the well bias generator, wherein the pumping capacitor is initialized such that the voltage at the node is determined by the threshold voltage of the clamp transistor.

5. The back bias generator for a semiconductor device according to claim 1, wherein the well bias generator comprises:

a first capacitor coupled between the oscillator and a second node;

a first field effect transistor having a first electrode coupled to the second node, and a gate and second electrode coupled to a ground terminal, for initializing the first capacitor; and a first diode coupled to the second node, for generating the well bias signal.

6. The back bias generator for a semiconductor device according to claim 1, wherein the well bias generator comprises:

a second capacitor coupled between the oscillator and a third node;

a second field effect transistor having a first electrode coupled to the third node, and a gate and second electrode coupled to a ground terminal, for initializing the second capacitor;

a second diode coupled to the third node, for generating the well bias signal; and a third field effect transistor having a first electrode and gate commonly coupled to the third node, and a second electrode coupled to receive the back bias signal.

7. The back bias generator for a semiconductor device according to claim 1, wherein the logic gate is a negative product gate.

8. The back bias generator for a semiconductor device according to claim 1, wherein the transfer transistor is an NMOS transistor.

9. The back bias generator for a semiconductor device according to claim 4, wherein the clamp transistor is an NMOS transistor.

10. A back bias generator for a semiconductor device comprising:

logic means for generating an oscillating logic signal that is at a first logic state if a power supply signal is below a predetermined level, a second logic state if a clock signal is at a first logic state, and the first logic state if the power supply signal is above the predetermined level and the clock signal is at a second logic state;

a pumping circuit coupled to the logic means, the pumping circuit generating a pumping signal responsive to the oscillating logic signal;

a transfer transistor having a bulk fabricated in a triple well structure coupled to the pumping circuit for receiving the pumping signal and generating a back bias signal; and bias means for generating a well bias signal coupled to the transfer transistor for providing a well bias signal to the bulk of the transfer transistor, thereby preventing leakage through the triple well structure.

11. A back bias generator according to claim 10 wherein the pumping circuit comprises:

a pumping capacitor coupled between the logic means; and a clamp transistor coupled to the pumping capacitor for initializing the voltage of the pumping capacitor, the clamp transistor having a bulk coupled to the bias means for receiving the well bias signal.

12. A back bias generator according to claim 10 wherein the bias means provides the well bias signal before the logic means causes the pumping capacitor to generate the pumping signal.

13. A back bias generator for a semiconductor device having a triple well structure comprising:

logic means for generating an oscillating logic signal that is at a first logic state if a power supply signal is below a predetermined level, a second logic state if a clock signal is at a first logic state, and the first logic state if the power supply signal is above the predetermined level and the clock signal is at a second logic state;

a pumping circuit coupled to the logic means, the pumping circuit generating a pumping signal responsive to the oscillating logic signal;

a transfer transistor having a bulk fabricated in a triple well structure coupled to the circuit for receiving the pumping signal and generating a back bias signal; and bias means for generating a well bias signal coupled to the transfer transistor for providing a well bias signal to the bulk of the transfer transistor, thereby preventing leakage through the triple well structure;

wherein the bias means includes:

a first capacitor having a first terminal coupled to receive the clock signal and a second terminal coupled to a node;

a first field effect transistor having a first electrode coupled to the node, and a gate and second electrode coupled to a ground terminal; and a diode having a cathode coupled to the node and an anode for generating the well bias signal.

14. A back bias generator according to claim 13, wherein the bias means further includes a second field effect transistor having a first electrode and gate commonly coupled to the node, and a second electrode coupled to receive the back bias signal.

15. A method for operating a back bias generator having a transfer transistor fabricated in a triple well structure, wherein a first well of the triple well structure forms the bulk of the transfer transistor, the method comprising:

generating a pumping signal;

applying the pumping signal to a first terminal of the transfer transistor;

generating a well bias signal; and applying the well bias signal to the bulk of the transfer transistor, thereby preventing leakage through the triple well structure.

16. A method according to claim 15 further including generating the well bias signal before generating the pumping signal.

17. A method according to claim 15 further including applying the well bias signal before applying the pumping signal.

18. A method according to claim 15 wherein the back bias generator includes a clamp transistor coupled to the first terminal of the transfer transistor, the clamp transistor having a bulk, the method further including applying the well bias signal to the bulk of the clamp transistor.

19. A method according to claim 15 wherein generating the well bias signal includes generating the well bias signal as soon as a power supply voltage is generated.

20. A method according to claim 15 wherein generating the pumping signal includes initializing a pumping capacitor to a voltage close to a power supply ground voltage.

* * * * *

UNITED STATES PATENT AND TRADEMARK OFFICE

CERTIFICATE OF CORRECTION

PATENT NO. : 6,175,263 B1
DATED : January 16, 2001
INVENTOR(S) : Lee et al.

It is certified that error appears in the above-identified patent and that said Letters Patent is hereby corrected as shown below:

Column 2,
Line 54, "lower then" should read -- lower than --.

Column 5,
Line 66, "Vp is goes high" should read -- Vp is high --.

Column 6,
Line 55, "N4 is can be expressed as:" should read -- N4 can be expressed as --.

Column 7,
Line 59, "lower then" should read -- lower than --.

Signed and Sealed this

Seventh Day of May, 2002

*Attest:*

*Attesting Officer*

JAMES E. ROGAN
*Director of the United States Patent and Trademark Office*